United States Patent [19]

DeGraff

[11] 4,141,666

[45] Feb. 27, 1979

[54] LOW HEADROOM CULVERT

[75] Inventor: Clifford A. DeGraff, Bedford, Ind.

[73] Assignee: Kaiser Aluminum & Chemical Corporation, Oakland, Calif.

[21] Appl. No.: 878,496

[22] Filed: Feb. 16, 1978

[51] Int. Cl.[2] ..... F16L 9/00

[52] U.S. Cl. ..... 405/126; 405/150

[58] Field of Search ..... 61/16, 14, 42, 45, 43; 52/80, 245

[56] References Cited

U.S. PATENT DOCUMENTS

| | | | |
|---|---|---|---|
| 587,392 | 8/1897 | Gray | 61/16 |
| 832,017 | 9/1906 | Hummel | 61/16 |
| 905,290 | 12/1908 | Cummings et al. | 61/16 |

*Primary Examiner*—Jacob Shapiro

*Attorney, Agent, or Firm*—Paul E. Calrow; John S. Rhoades

[57] ABSTRACT

Improved low headroom culvert comprised of a plurality of shallow arch-shaped corrugated culvert sections and elongated unitary load transferring stringer stiffener elements, the stringer stiffener elements being arranged in generally spaced parallel relation to each other and secured to the inside surfaces of said sections. The stringer elements extend for substantially the full length of the culvert thereby acting to integrate the culvert sections into a unitary overall culvert structure. Certain of the stringer elements are located a selected distance inwardly from the free bottom edges of the culvert sections and provide combination culvert reinforcing stringer elements and elongated footings and soil supports.

5 Claims, 5 Drawing Figures

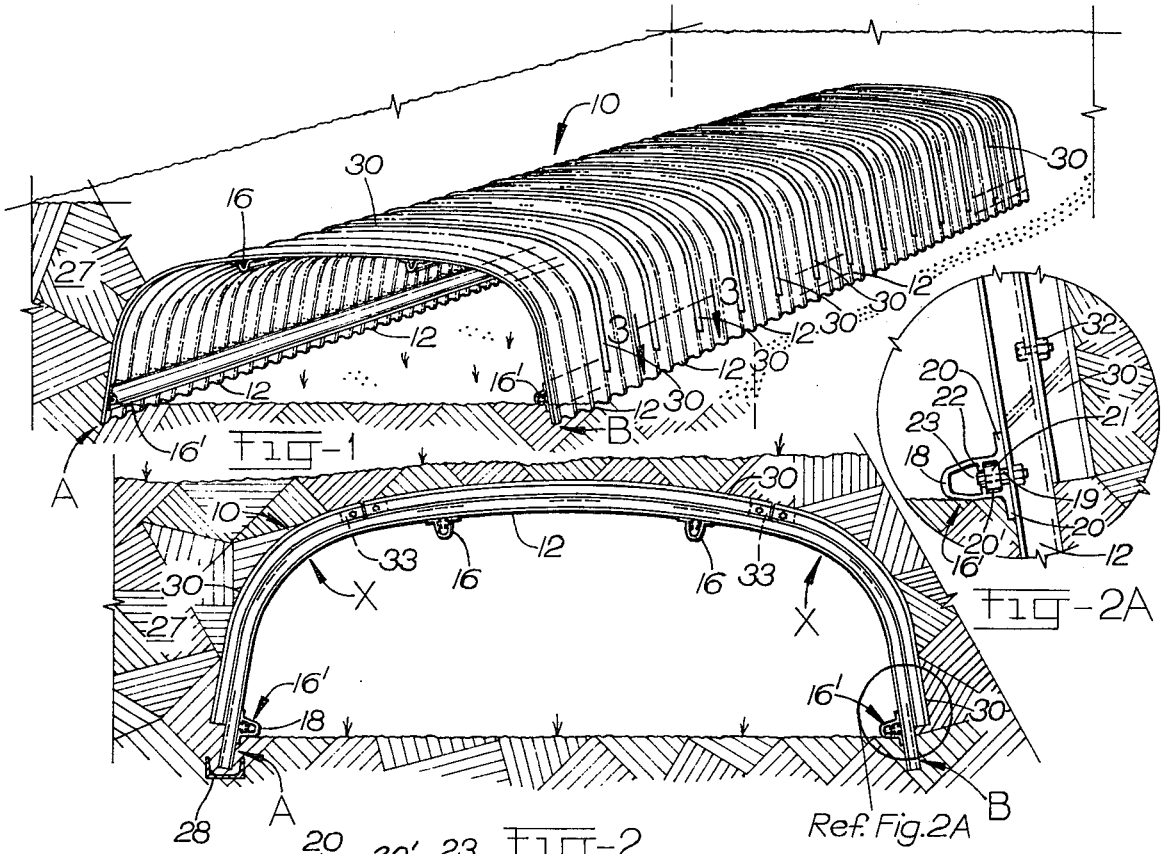
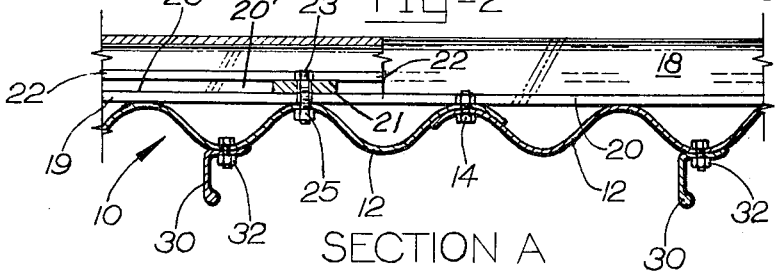
Fig-3
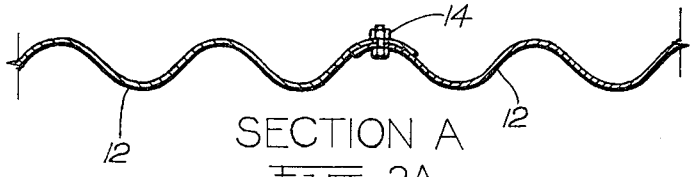
Fig-3A

LOW HEADROOM CULVERT

BACKGROUND OF THE INVENTION

The present invention relates to culvert structures and, more particularly, to low headroom culvert structures made up of a series of shallow arch-shaped corrugated sections reinforced and secured together in an improved fashion to form an elongated culvert.

In the past, low headroom, drainage and flood control culverts, etc., were made up of appropriate shallow arch sections and required full reinforcing floors or bottom sections to prevent culvert section failure during installation and use because of the shallow arch configuration, even when the culvert sections were stiffened by corrugations. This full flooring was secured to the opposing free bottom edges of the culvert arches and by tieing these ends or edges together transformed the culvert into a box-like shape and prevented the arched sections from spreading out and collapsing under loads. The flooring served an additional function in that it helped to nullify or minimize erosion of the soil between and adjacent the arch frames which, over a period of time, could otherwise produce the partial or total collapse of the culvert and require its ultimate removal and replacement. The use of such full flooring, however, materially increased the amount of material used and, in turn, the cost to the user. Examples of such prior art floored and corrugated culvert structures are shown in U.S. Pat. Nos. 950,928; 1,013,440; 1,040,442; 1,071,185; 1,926,843; 1,935,273; and 2,343,029.

Certain other prior art culverts, some of box-shape and low arch configuration, were also provided with internal or external footings, antiwash aprons, etc., some of simple and others of complex construction for the purpose of anchoring the culverts in place and minimizing soil erosion and displacement of the culvert sections. Examples of culverts provided with such footings, etc., are illustrated in U.S. Pat. Nos. 1,928,480; 1,955,407; 1,964,313; 2,126,091; 2,126,870; and 2,343,029. When these footings, etc., were utilized, however, they also required additional materials as well as special on-site installation preparations and procedures all of which added to the cost of the final culvert.

The proposed culvert structure constitutes an improvement over the prior art culvert structures as represented, for example, by the aforementioned prior art patents as well as an improvement over typical structural metal plate drainage systems including box-like culverts as illustrated in various brochures distributed by Kaiser Aluminum & Chemical Sales, Inc., Oakland, California, such as a brochure entitled "Aluminum Structural Plate" printed in 1965; a brochure entitled "Aluminum Structural Plate" copyrighted in 1974; and a brochure entitled "Aluminum Storm Sewers" copyrighted in 1976. Finally, the instant culvert is an improvement over the culvert structure of U.S. Pat. No. 3,508,406 which uses concrete beams secured to the outside of the culvert sections to reinforce the culvert and the trussed culvert of U.S. Pat. No. 1,999,500.

The instant low headroom culvert design advantageously minimizes the number of parts employed in the culvert structure while possessing substantially equivalent strength characteristics to those possessed by the low headroom culvert structures of the past which employed full bottom tie sections.

SUMMARY OF THE INVENTION

The instant invention is concerned with a low headroom culvert made up of a series of shallow arch sections, wherein a plurality of elongated aluminum extrusions or stiffener elements of hollow beam-like configuration are secured to the inside surfaces of the culvert sections. Certain of these extruded stringer elements are located a selected distance inwardly from the free bottom edges of the culvert sections to provide combination stiffeners and elongated footings and soil supports for the culvert. These stringer elements advantageously act to integrate all of the culvert sections one with another, and this culvert section integration advantageously provides for transferring and distributing concentrated and localized loads which are primarily compression loads along substantially the full length of the culvert. This load distribution advantageously enhances the overall useful life of the structure and helps to protect against localized failures and collapse. Location of the stringers on the inside of the culvert acts to prevent collapse of the culvert during the soil backfilling that occurs in the on-site culvert installation, but without, at the same time, interfering with the backfilling operations.

In addition to certain of these stringers acting, as noted, in the manner of stiffeners and footings that anchor the culvert in the soil, they also serve as bumpers for contacting various objects, such as logs or other debris, that may pass through the culvert and which, unless protected against, might otherwise severely damage the culvert.

In summary, the novel overall culvert design provided by the instant invention produces a relatively versatile culvert that retains its integrity, strength and individual section efficiency irrespective of installation in varying soils and differing climatic conditions and environments that can range from arctic to equatorial.

BRIEF DESCRIPTION OF THE DRAWINGS

FIG. 1 is a perspective view of the improved shallow-arched culvert structure of the instant invention;

FIG. 2 is an end view of the culvert structure shown in FIG. 1 with parts added;

FIG. 2A is an enlarged fragmentary end view taken within the circumscribing circle 2(A) of FIG. 2, and illustrates the manner in which the stringer stiffener elements are secured to the arched sections making up the culvert;

FIG. 3 is a fragmentary and partly broken away sectional view taken along the line 3—3 of FIG. 1; and FIG. 3A is a similar view to FIG. 3, with the reinforcing cross-ribs removed.

DETAILED DESCRIPTION

With further reference to the drawings, the low headroom culvert structure 10 of the instant invention is comprised of a series of individual preformed shallow culvert sections 12. Sections 12 are preferably corrugated and they are overlapped and secured to each other at their side edges in a well-known manner as indicated, for example, in FIGS. 3 and 3A by appropriate rivets, bolts or other fastening elements 14.

After the desired number of individual arched culvert sections 12 have been overlapped and secured together at their side edges, as noted, to form the basic culvert structure 10, a plurality of elongated reinforcing stiffener stringer elements or box beams 16 are secured to the inside surfaces of the crests of the corrugated culvert sections 12 in the manner indicated particularly in FIGS. 2A and 3.

In an advantageous embodiment of the invention, stringer elements 16 are preferably made in the form of rugged box-shaped aluminum extrusions that include a main outwardly rounded and hollow-body portion 18, an open mouth 19 and depending flanges or feet 20. Stringers 16 preferably extend the full length of the culvert for purposes to be hereinafter described. The hollow interiors of the stringer extrusions are provided with opposed spaced ribs 22 that parallel feet 20 and form in conjunction with feet 20 a channel 20' for receiving apertured locking plates 21. When bolts 23 are inserted in the apertures of plates 21 and passed through mouth 19, they can then be passed through holes in sections 12 and locked in place by nuts 25 or the like thereby locking the stringers 16 to the sections 12. For ease of assembly, the individual stringers 16 can be anchored to each section 12 as that section 12 is overlapped and secured to an adjacent section 12 by bolts 14, etc. In lieu of using the anchor blocks 21, holes can be drilled in feet 20 and corresponding holes in sections 12 for receiving the anchor bolts 23.

By extending substantially the entire length of the culvert structure, and by being secured to the inside surfaces of the culvert sections by means of rivets or bolts 23, the stringers 16 provide the following advantageous features. Firstly, the stringers act as stiffening members in that they strengthen the culvert sections and the overall culvert 10 against collapse during use as well as during installation when soil backfill material 27 is dumped and compacted about the culvert 10 for the full length of the culvert. Secondly, since each stringer 16 is preferably in the form of a unitary extrusion, these stringers act both to integrate the individual sections 12 into a singular structure and as efficient load transfer mediums that distribute localized loads throughout the culvert. Thirdly, these stiffeners function as substitutes for the flooring in prior art low headroom culverts, and stiffen and reinforce the culvert 10 against collapse. A further advantageous feature of the stringer elements resides in locating certain of these elements 16' a selected distance inwardly, from the bottom end edges A and B of the culvert sections 12. Thus these lowermost stringers 16' which protrude some distance into the interior of the culvert from sections 12, e.g., four to five inches, can then serve as footings and soil supports for the culvert whereby the culvert 10 can be supported in many environments or soils by means of stringer stiffeners 16' alone and without requiring channel foot pads 28 or the like.

In a further advantageous embodiment of the invention, the culvert can be provided with additional cross-rib and stiffener elements 30, also in the form of aluminum extrusions. Cross-ribs 30 can be roughly angle-shaped in cross-section with one of the angle flanges being welded or secured by bolt means 32, or the like, to the crests and on the outside of certain of the individual culvert section corrugations. The reinforcement provided by cross-ribs 30, in conjunction with the longitudinal ribbing or stiffening, effected by means of stringer elements 16 plus the corrugations of sections 12, provide for an extremely strong, low headroom or shallow culvert despite the lack of the usual flooring. The individual cross-stiffeners 30 are preferably not continuous but segmented. These segments are spliced together in the areas of the main side arcs X by well-known splice plates 33 shown in dotted lines in FIG. 2. The number of stiffeners 16 and 16' as well as the number of cross-ribs 30 that are to be used for a given culvert will depend upon the particular environment in which the culvert structure is utilized, the expected loads, the thickness or gauge of the sections 12 and the depth of the individual corrugations thereof. Cross-ribs 30 also preferably extend to the level of the lower stringers 16' for imparting maximum stiffness and lower stringers 16' can also function advantageously as bumpers which protect the inside of the culvert 10 against damage from debris, such as logs or trees that may pass through and possibly be caught in the culvert.

Culvert sections 12 are advantageously made of corrosion resistant aluminum alloys, such as an alloy designated as a 5052-H141 alloy by The Aluminum Association in the United States, while the hollow beam stiffeners 16 and 16' and cross-ribbing 30 can be made from an aluminum alloy designated as a 6063-T6 alloy by The Aluminum Association.

Advantageous embodiments of the invention have been shown and described. It is obvious that various changes and modifications may be made therein without departing from the spirit and scope thereof as defined by the appended claims wherein:

What is claimed is:

1. A bottomless culvert structure of the type described comprising the combination of a plurality of relatively shallow arch-shaped corrugated culvert sections overlappingly secured to each other at their edges to form an elongated low headroom culvert, elongated extruded unitary hollow stiffener stringer elements disposed in generally spaced parallel relation to each other and secured to the inside surfaces of said arch-shaped culvert sections, said stringer elements extending for substantially the full length of the culvert and integrating said culvert sections one with another to form a unitary culvert structure, certain of said stringer elements also being located a selected distance inwardly from the bottom end edges of said culvert sections to provide elongated footings and soil supports for said culvert and said stringer elements comprising hollow box beams provided with an outwardly rounded body portion and feet depending therefrom for engaging the corrugated culvert sections.

2. A culvert structure as set forth in claim 1 including means securing said box beams to said culvert sections, said means including ribs on the interior of a hollow box beam that are located in spaced parallel relationship to the box beam feet and said ribs forming in conjunction with said feet a channel for receiving apertured beam locking plates.

3. A culvert structure as set forth in claim 2 including stiffening cross-ribs secured to the outside surfaces of said corrugated culvert sections and arranged cross-ways to said stringer elements, said stiffening cross-ribs being located in spaced parallel relationship to each other.

4. A culvert structure as set forth in claim 3, wherein said stiffening cross-ribs are arranged transversely to said stiffener stringer elements and the bottom end edges of said stiffening cross-ribs extend at least to the level of the stiffener stringer elements forming the culvert footings.

5. A low headroom culvert structure as set forth in claim 3, wherein said stiffening cross-ribs are angle-shaped in cross-section and are each comprised of a plurality of segments.

* * * * *